US006111545A

United States Patent [19]

Saari

[11] Patent Number: 6,111,545

[45] Date of Patent: Aug. 29, 2000

[54] ANTENNA

[75] Inventor: Timo Saari, Pori, Finland

[73] Assignee: Nokia Mobile Phones, Ltd., Espoo, Finland

[21] Appl. No.: 09/252,159

[22] Filed: Feb. 18, 1999

[51] Int. Cl.[7] ..... H01Q 1/24; H01Q 1/38

[52] U.S. Cl. ..... 343/702; 343/895; 343/700 MS

[58] Field of Search ..... 343/702, 895, 343/700 MS; H01Q 1/24, 1/38

[56] References Cited

U.S. PATENT DOCUMENTS

| | | | |
|---|---|---|---|
| 4,860,019 | 8/1989 | Jiang et al. | 343/795 |
| 4,998,078 | 3/1991 | Hulkko | 333/109 |
| 5,276,920 | 1/1994 | Kuisma | 455/101 |
| 5,341,149 | 8/1994 | Valimaa et al. | 343/895 |
| 5,363,114 | 11/1994 | Shoemaker | 343/828 |
| 5,412,392 | 5/1995 | Tsunekawa | 343/702 |
| 5,561,439 | 10/1996 | Moilanen | 343/846 |
| 5,627,550 | 5/1997 | Sanad | 343/700 MS |
| 5,657,028 | 8/1997 | Sanad | 343/700 MS |
| 5,680,144 | 10/1997 | Sanad | 343/700 MS |
| 5,832,372 | 11/1998 | Clelland et al. | 455/115 |
| 5,854,970 | 12/1998 | Kivela | 455/90 |
| 5,856,806 | 1/1999 | Koleda | 343/702 |
| 5,977,928 | 11/1999 | Ying et al. | 343/702 |

FOREIGN PATENT DOCUMENTS 0 814 536 A2 12/1997 European Pat. Off. .

*Primary Examiner*—Hoanganh Le
*Attorney, Agent, or Firm*—Perman & Green, LLP

[57] ABSTRACT

The invention comprises an antenna structure particularly suited for mobile stations. The antenna comprises a radiating element (100) which is of a conductor form. The antenna conductor comprises a basic conductor and as an extension to this a conductor (115, 116) which at least partly is located relatively close to the basic conductor. As the conductors are close to each other that causes an electromagnetic coupling, which again causes a second resonance frequency for the antenna. The bandwidth of the antenna can be widened when the second resonance frequency is arranged close to the first one. The antenna can be made as a two-band antenna when the second resonance frequency is arranged relatively far from the first one. The bands can be made relatively wide, so that the antenna operates satisfactorily in different positions and in the neighbourhood of objects. It can be fastened to the back wall of a mobile station, whereby the distance to the user's head is made as large as possible.

15 Claims, 3 Drawing Sheets

ANTENNA

TECHNICAL FIELD OF THE INVENTION

The object of the invention is an antenna structure defined in the preamble of claim 1, particularly an antenna structure suitable for mobile stations.

BACKGROUND OF THE INVENTION

The progress of mobile station techniques have brought and will bring to the marketplace new and versatile models, in which new requirements are placed on the antennas: for instance, the antenna must operate on two frequency ranges, such as the 900 MHz and 1.8 GHz ranges; the bandwidth or bandwidths must be relatively wide; the radiation and reception characteristics must be rather good when the device and the antenna are in different positions and in different locations regarding external objects; and yet the antenna must be relatively small and compact.

There are previously known antenna structures suitable for mobile stations which have a wide bandwidth or which operate on two frequency ranges.

Antennas based on a helix:

Within a helix element there is placed a rod element resonating at a different frequency, whereby the rod element is fed separately or in common with the helix element, or it could be a parasitic rod. Disadvantages of such structures are the relatively high manufacturing costs and clearly deteriorated characteristics, when the antenna is located or turned close to the frame of the device.

Microstrip structures:

On the surfaces of and possibly within a dielectric plate there are radiating conductor areas, of which one or more can be a feed area, and of which one or more can be parasitic areas. The conductor areas can also be designed so that they contain one or more gaps acting as radiators. A disadvantage of most microstrip structures are their relatively narrow bandwidths. This disadvantage is less pronounced in structures containing parasitic elements, but then a disadvantage will be the relatively large size of the structure. The characteristics of microstrip antennas are also subject to drift, and the costs of structures fulfilling said requirements are rather high.

Chip structures:

Within a dielectric monolithic body there are one or more conductors, for instance with a meander form, which radiate at different frequencies. A disadvantage of these structures are the relatively narrow bandwidths, if the bands are separate.

SUMMARY OF THE INVENTION

The object of the invention is to reduce the above mentioned disadvantages relating to the prior art. An antenna according to the invention is characterised in what is presented in the independent claim regarding an antenna. A mobile station according to the invention is characterised in what is presented in the independent claim regarding a mobile station. Some preferred embodiments of the invention are presented in the dependent claims.

The basic idea of the invention is as follows: The basis of the structure is a quarterwave antenna, which can be electrically shortened with the aid of the design of a radiating conductor. Then the conductor is extended, as seen from the end opposite to the feeding end, so that at least a part of the extended conductor is located rather close to the original antenna structure. In this way an electromagnetic feed-back is created in the antenna. The feed-back provides the antenna with an extra resonance frequency at a desired point on the frequency axis.

One advantage of the invention is that the antenna can be made into a two-band antenna by arranging the first resonance frequency for instance in the 900 MHz band and the second one for instance in the 1.8 GHz band. The bandwidth can also be made relatively wide in both operating ranges, which is important particularly when the device is used in different positions. An advantage of the invention is further that the bandwidth of an antenna intended for single-band operation can be expanded by arranging a second resonance frequency close to the first one. A wider band also means a better matching in different operating positions of the device. A further advantage is that the antenna can be made very small and flat. On one hand it can then be turned into a protected position near the frame of the device, and on the other hand its electric properties are kept at an acceptable level in the protected position, because the distance to the frame of the device remains relatively large. A further advantage of the invention is that due to the flat form of the antenna it can in mobile phones be fastened to the back wall of the device, whereby the power emitted from the telephone to the user's body is kept as low as possible, which is advantageous due to the power consumption savings in the mobile station. A further advantage of the invention is that the antenna can be rather freely located, because it does not require any particular dielectric medium nor any parasitic elements. Due to the same reason the characteristics of the antenna remain stable over time and in changing environmental conditions. A further advantage of the invention is that the costs of the antenna are relatively low due to the very simple structure.

BRIEF DESCRIPTION OF THE DRAWINGS

The invention is described in detail below. In the description reference is made to the enclosed drawings, in which.

DETAILED DESCRIPTION

Figure 1A:
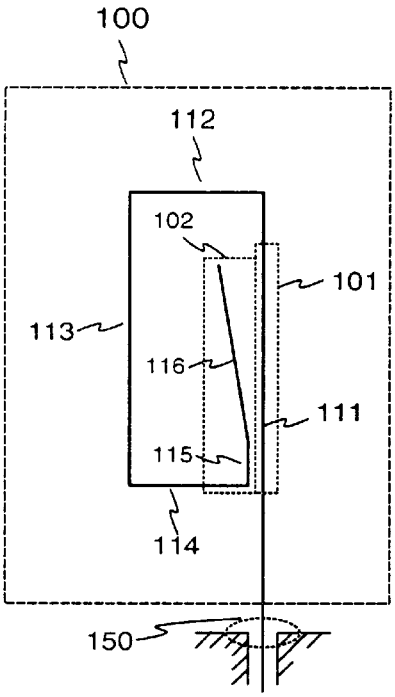
FIGS. 1*a* and 1*b* show an example of antennas according to a preferred embodiment of the invention.
Figure 1B:
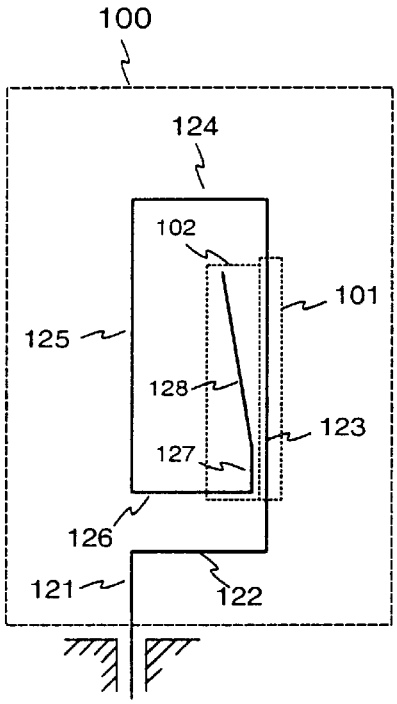

FIG. 1 is an example of a structure according to a preferred embodiment of the invention which provides an antenna with two operating bands, which are relatively far from each other. The structure includes an antenna conductor 100 which seen from the feeder 150 first extends upwards (111), then sidewards (112), further downwards (113) and then sidewards (114) towards the section 111. Let's call the conductor formed by these sections the basic conductor. The basic conductor has an extension directed upwards and containing a vertical section 115 and a bent oblique section 116. The basic conductor and its extension together form the antenna conductor. The antenna does not necessarily require anything else than the conductor shown in the figure, for instance no dielectric matter nor any separate support element. FIG. 1*b* shows a structure which in other respects is similar to that of figure 1*a*, except that the vertical section 111 is replaced by a vertical section 121, a horizontal section 122 and a vertical section 123. The length of the added horizontal section 122 is of the same order as the other horizontal sections. In this description and particularly in the claims a "vertical section" means a substantially vertical part of a conductor and a "horizontal section" means a substantially horizontal part of a conductor, when the antenna points upwards. An "oblique section" means a part of a conductor having a direction which differs from both the directions of a vertical section and a horizontal section. Thus the terms "vertical section", "horizontal section" and "oblique section" are in no way connected to the operating position of the device.

The structure of FIG. 1*a* has a first resonance frequency, the magnitude of which depends on the total length of the antenna conductor. Between the sections 115 and 116 and the vertical sections 111 there is an electromagnetic coupling causing a second resonance frequency which in this case is substantially above the lower, i.e. the first resonance frequency. The value of the higher, i.e. the second resonance frequency depends mainly on the lengths of the vertical sections. The first band means that frequency range around the first resonance frequency where the antenna is able to radiate substantially. Correspondingly, the second band means that frequency range around the second resonance frequency where the antenna is able to radiate substantially. The width of the first band depends on the ratio of the lengths of the horizontal sections 112 and 114 and on the distance between the vertical sections 115 and 111. The width of the second band again depends mainly on the mutual relations between the parts of the electromagnetic coupling: the distance between the vertical sections 115 and 111 and the angle between the oblique section 116 and the vertical section 111. The vertical section 115 and the oblique section 116 are at a close distance to the vertical section 111. "Close distance" means in this description and particularly in the claims such a distance between two sections of the antenna that the coupling between them substantially affects the radiation characteristics of the antenna, however so that said radiation characteristics are at least substantially retained at the first band. A close distance can for instance be of the order of $\lambda/100$, where $\lambda$ is the wavelength of the radiation of the antenna.

Figure 5A:
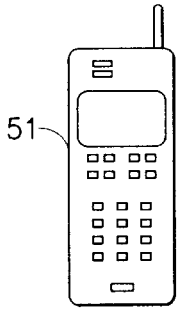
Figure 5B:
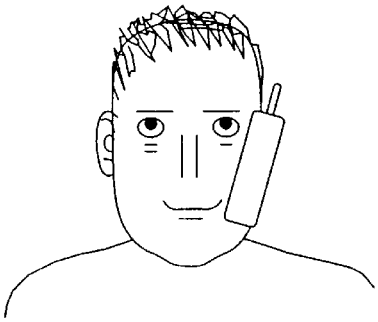
Figure 5C:
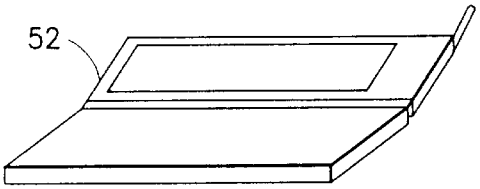
Figure 5D:
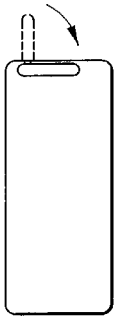

The structures according to FIG. 1 are characterised in that they can provide relatively large bandwidths, particularly a wide upper bandwidth. The antenna band characteristics are often examined by measuring its reflection coefficient, i.e. the parameter $S_{11}$ or the return loss $A_r$, as a function of the frequency. The return loss means the ratio of the energy supplied to the antenna to the energy returning from it. It is the inverse of the square of the absolute value of the reflection coefficient. The higher the return loss is, the greater part of the energy supplied into the antenna will radiate into the environment, i.e. the better the antenna functions. In the ideal case the return loss is thus infinite. When the return loss is one or 0 dB the antenna will not radiate at all: the energy supplied into it will return to the feeding source. The reception characteristics of the antenna follow the transmission characteristics: the more effectively the antenna transmits at a certain frequency and in a certain direction, the more effectively it also receives said frequency from said direction. The bandwidth of an antenna can be defined in different ways: It can mean the difference between those frequencies at which the return loss has decreased 3 dB from the best value, i.e. from the maximum value. However, often the bandwidth is regarded as the difference between those frequencies at which the return loss obtains a certain value, for instance 10 dB=10, or 5 dB≈3.2. The former value corresponds to a standing wave ratio SWR=1.9 which represents the quality of the antenna matching, are shown in FIG. 5. In FIG. 5*a* the antenna of the mobile station is at the top and pointing upwards, and there are no other objects close to the mobile station. In FIG. 5*b* there is a human head adjacent the mobile station. In FIG. 5*c* there is a multi-function mobile station having its antenna at the top, but in an oblique position, as it could be during use. In FIG. 5*d* the antenna is turned into a protected position close to the cover of the mobile station. The curve 31 represents the situation of FIG. 5*a*, the curve 32 represents the situation of FIG. 5*b*, the curve 33 represents the situation of FIG. 5*c*, and the curve 34 represents the situation of FIG. 5*d*. In this example the antenna is intended to operate on one hand in the band used by the GSM network and on the other hand in the band used by both the PCN and PCS networks. The two latter cover the band between 1.71 GHz and 1.98 GHz, wherefore particularly the second band, i.e. the upper band of the antenna must be a wide one. From the curves it is seen that a condition of an acceptable operation is met, except for the curve 34, when a return loss $A_r$ value of 5 dB is considered as the limit. In this case, i.e. in the case of a down turned antenna the antenna operates unsatisfactorily at the upper end of the bands used by both the GSM and PCS networks. The figures are measurement results obtained in an exemplary test arrangement, and thus they do not represent the performance of a finally optimised product.

When the mobile station is in a vertical position the radiation generated by the antennas according to FIG. 1 in a common mobile station is mainly vertically polarised; the difference to the horizontally polarised field strength is almost 10 dB on the average. The directional pattern regarding the vertically polarised field is relatively even. When mounted in a certain multi-function mobile station said polarisation difference can not be detected on the basis of a certain measurement arrangement.

Figure 2A:
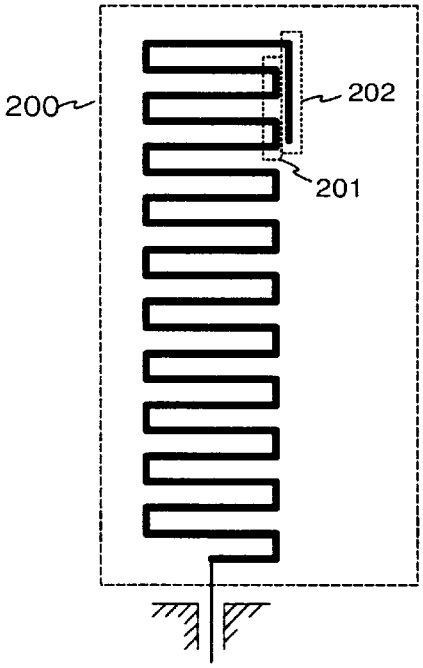
FIGS. 2*a* and 2*b* show other examples of antennas according to a preferred embodiment of the invention.
Figure 2B:
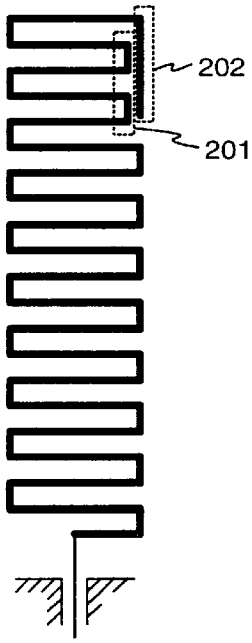
Figure 3:
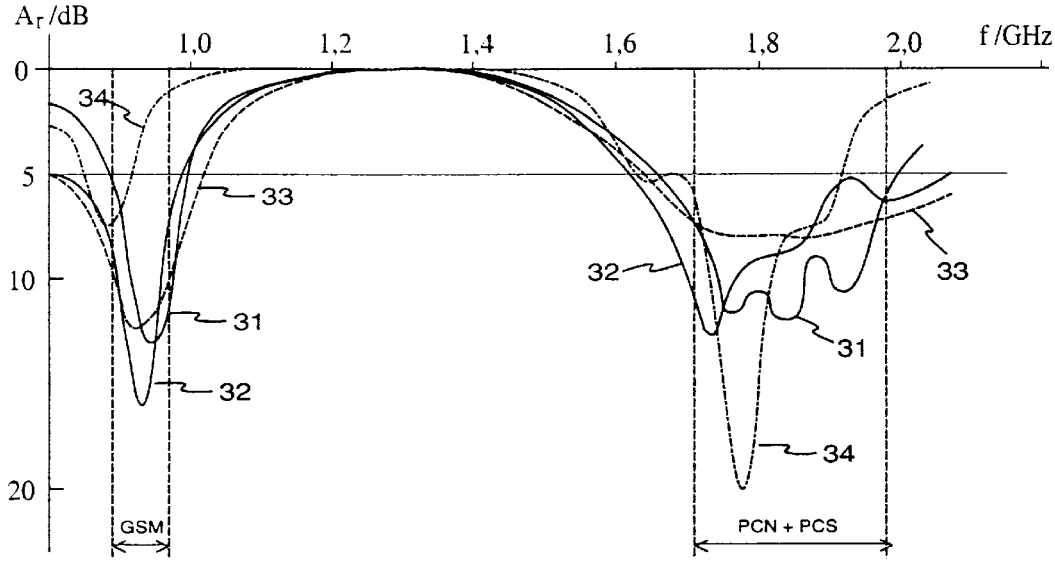
FIG. 3 shows characteristics of the band of antennas according to FIG. 1.

FIG. 2*a* shows an example of a structure where the bandwidth of an one-band antenna 200 is extended according to the invention. The basic conductor in this structure forms a rectangular meander pattern. The term "meander" means a continuous line without branching points and having a certain basic pattern or a variation of the basic pattern or different basic patterns successively repeated in the same direction. As an extension of the meander pattern there is adjacent one side of it a vertical section 202, which has an electromagnetic coupling the to the closest parts 201 of the meander pattern. This results in a further resonance frequency relatively close the main resonance frequency of the basic structure. FIG. 2*b* shows a structure which is similar to that of FIG. 2*a*, except that the meander pattern is made narrower at the upper part, so that the total width of the antenna is kept constant, taking into consideration the extension, i.e. the vertical section 202.

Figure 4:
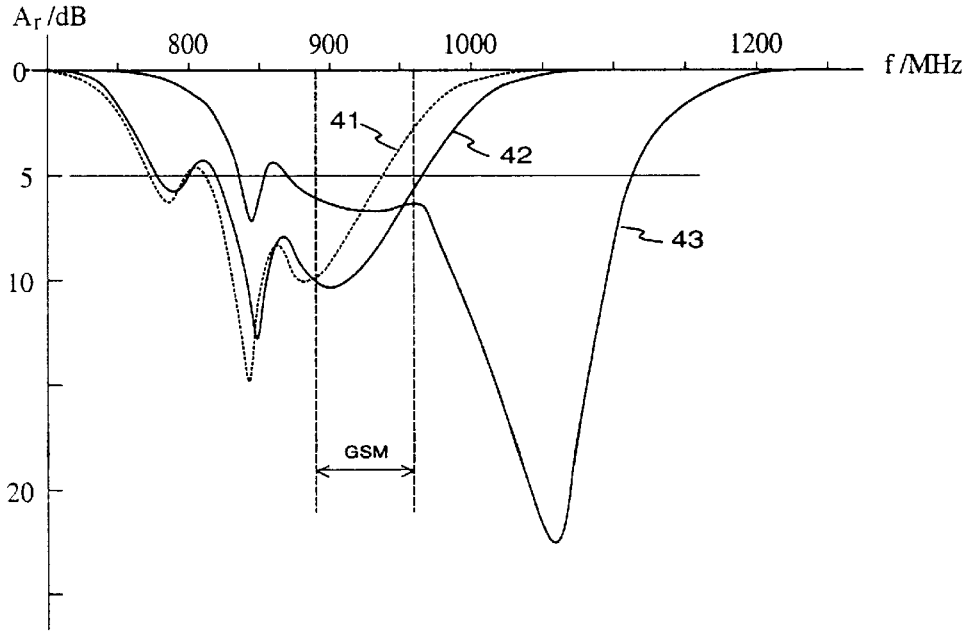
FIG. 4 shows characteristics of the band of antennas according to FIG. 2, FIGS. 5*a*–5*d* show an antenna according to a preferred embodiment of the invention mounted in a mobile station in different situations.

FIG. 4 is an example of the effect caused by the vertical section 202 on the bandwidth of the antennas according to FIG. 2. The curves 41 and 42 represent the return loss $A_r$ as a function of the frequency in an antenna with a meander pattern, which is turned into the protected position according to the FIG. 5*d*. The curve 41 represents an antenna without the vertical section 202, and the curve 42 represents an antenna according to the invention having a vertical section 202. In the latter case the tail edge of the band is moved about 50 MHz further. The front edge of the band has also moved a little further. A satisfactory operation is achieved in the range used by the GSM network, because the band is widened. The curve 43 represents the return loss in free space when the antenna is in a normal operating position. There is only one curve, because the band does not substantially change with the addition according to the invention. The aim in said structure was also to improve the antenna characteristics only in said protective position.

Figure 6A:
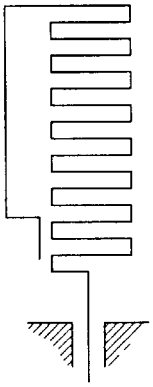
FIG. 6*a*–6*c* show some variations of the antenna structure according to the invention.
Figure 6B:
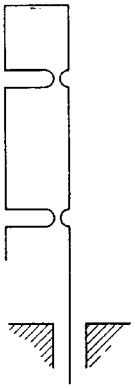
Figure 6C:
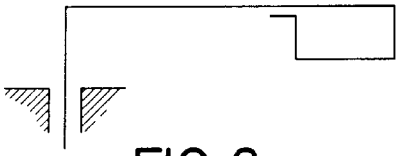

Some antenna structures according to the invention and their characteristics were described above. The invention is not limited to the above described solutions. FIG. 6 shows examples of possible applications. FIG. 6*a* has a meander structure where an electromagnetic feed-back is made close to the feeding point of the antenna. The structure of FIG. 6*b* has two coupling points relatively far from each other. In FIG. 6*c* the invention is applied in an L-antenna. The inventive idea can be applied in numerous ways within the limits defined by the claims.

What is claimed is:

1. An antenna comprising a conductor which has a first end and a second end, whereby said first end is arranged to be connected to the antenna feeding conductor and whereby said second end is an open end of the antenna, characterised in that the conductor forms a substantially planar pattern, said second end being closer to said first end than a first point of the conductor between said first and second ends, and said second end being closer to a second point of the conductor than to said first end, said second point being located, when measured along the conductor, between said first point and said first end, for forming an electromagnetic feedback coupling between said second end and said second point of said conductor in order to create a resonance frequency.

2. The antenna according to claim 1, characterised in that said conductor forms a pattern which comprises the following sections in this order starting from said first end:

a first section in a first direction, a second section in a second direction, whereby said second direction is approximately perpendicular to said first direction, a third section in a third direction, whereby said third direction is approximately opposite to said first direction, a fourth section in a fourth direction, whereby said fourth direction is approximately opposite to said second direction, a fifth section approximately in said first direction, and a sixth section, whereby said sixth section is directed in a direction which substantially differs from the directions mentioned above in this claim, and that said second section and said fourth section both are shorter than said first section and said third section.

3. The antenna according to claim 1, characterised in that said conductor forms a pattern which comprises the following sections in this order starting from said first end:

a first section in a first direction, a second section in a second direction, whereby said second direction is approximately perpendicular to said first direction, a third section approximately in the first direction, a fourth section in a third direction, whereby said third direction is approximately opposite to said second direction, a fifth section in a fourth direction, whereby said fourth direction is approximately opposite to said first direction, a sixth section approximately in said second direction, a seventh section approximately in said first direction, and an eighth section, whereby said eighth section is directed in a direction which substantially differs from the directions mentioned above in this claim, and that said second section, said fourth section and said sixth section all are shorter than said third section and said fifth section.

4. The antenna according to claim 1, characterised in that said conductor forms a pattern which comprises the following sections in this order starting from said first end: a section of a meander type in a first direction, a straight section in a second direction, whereby said second direction is approximately opposite to said first direction.

5. The antenna according claim 1, characterised in that said conductor is self-supporting.

6. The antenna according to claim 1, wherein a gap between the conductor at said second point and said second end of the conductor is sufficiently small to create said resonance frequency.

7. The antenna according to claim 6, wherein the gap is on the order of $\lambda/100$, where $\lambda$ is the wavelength at the operating frequency of the antenna.

8. The antenna according to claim 6, wherein the gap is narrower than any other gap between any other two parts of the conductor.

9. The antenna according to claim 1, wherein the second end of the conductor is canted away from the second point of the conductor towards its free end.

10. A mobile station having an antenna, which has a conductor having a first end and a second end, whereby said first end is arranged to be connected to an antenna feeding conductor and whereby said second end is an open end of the antenna, characterised in that the conductor forms a substantially planar pattern, said second end being closer to said first end than a first point of the conductor between said first and second ends, and said second end being closer to a second point of the conductor than to said first end, said second point being located, when measured along the conductor, between said first point and said first end, for forming an electromagnetic feedback coupling between said second end and said second point of said conductor in order to create a resonance frequency.

11. The mobile station according to claim 10, characterised in that said antenna is located inside a wall of the cover of a mobile station.

12. The antenna according to claim 4, wherein a gap between the conductor at said second point and said second end of the conductor is sufficiently small to create said resonance frequency.

13. The antenna according to claim 12, wherein -the gap is on the order of $\lambda/100$, where $\lambda$ is the wavelength at the operating frequency of the antenna.

14. The antenna according to claim 12, wherein the gap is narrower than any other gap between any other two parts of the conductor.

15. The antenna according to claim 11, wherein the second end of the conductor is canted away from the second point of the conductor towards its free end.

* * * * *